US007249656B2

(12) United States Patent
Huber et al.

(10) Patent No.: US 7,249,656 B2
(45) Date of Patent: Jul. 31, 2007

(54) BUFFER AND ELEVATOR INSTALLATION WITH SUCH A BUFFER

(75) Inventors: Marcel Huber, Ebikon (CH); Johannes Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 236 days.

(21) Appl. No.: 10/845,532

(22) Filed: May 14, 2004

(65) Prior Publication Data

US 2004/0251087 A1 Dec. 16, 2004

(30) Foreign Application Priority Data

May 21, 2003 (EP) ..... 03405351

(51) Int. Cl.
*B66B 5/28* (2006.01)
*B66B 5/16* (2006.01)

(52) U.S. Cl. ..... 187/343; 187/357

(58) Field of Classification Search ..... 187/343, 187/357

See application file for complete search history.

(56) References Cited

U.S. PATENT DOCUMENTS 5,469,937 A * 11/1995 Hakala et al. ..... 187/266
5,727,657 A * 3/1998 Foelix ..... 187/356
5,806,633 A * 9/1998 Macuga ..... 187/357
6,095,288 A * 8/2000 Rivera et al. ..... 187/343
6,138,798 A * 10/2000 Macuga ..... 187/294
6,736,242 B2 * 5/2004 Nygren ..... 187/357
7,077,243 B2 * 7/2006 Huber et al. ..... 187/357

FOREIGN PATENT DOCUMENTS

WO WO 00/64798 11/2000

* cited by examiner

*Primary Examiner*—Patrick Mackey
*Assistant Examiner*—Eric E. Pico
(74) *Attorney, Agent, or Firm*—Fraser Clemens Martin & Miller LLC; William J. Clemens

(57) ABSTRACT

A buffer supports an elevator car and/or a counterweight for the elevator car, wherein the elevator car and the counterweight are each movable along a respective path in an elevator shaft. The buffer partly projects into the path of the elevator car and the path of the counterweight to produce a mechanical contact with the elevator car when the elevator car moves below a first spacing with respect to a floor of the shaft. The buffer additionally produces a mechanical contact with the counterweight when the counterweight falls below a second spacing with respect to the floor.

13 Claims, 3 Drawing Sheets

BUFFER AND ELEVATOR INSTALLATION WITH SUCH A BUFFER

BACKGROUND OF THE INVENTION

The present invention relates to a buffer for supporting an elevator car and/or for supporting a counterweight for the elevator car, and an elevator installation with such a buffer.

Elevator installations are usually provided with one or more buffers which are arranged at the shaft floor of an elevator shaft in order to stop the elevator car when overrunning the lowermost stopping position in the elevator shaft in the downward direction and/or when overrunning the uppermost stopping position in the elevator shaft in the upward direction after transit of a predetermined travel path. This buffer is usually seated below the elevator car and/or the counterweight.

In order to prevent overrunning of an uppermost stopping position in the elevator shaft in the upward direction at the latest after transiting a predetermined travel path, buffers can also be arranged at the shaft head above the elevator car. Due to the fact that such buffers have to be arranged at the shaft floor and shaft head directly below or above the elevator car, a specific space requirement results. The shaft head or the shaft floor can therefore only be conditionally utilized for other purposes. In the case of elevator installations without a shaft pit, such a standard arrangement of a buffer is not possible, since little space is present underneath the elevator car.

An elevator installation with an elevator shaft, a vertically movable elevator car with counterweight and with buffers is described in PCT Patent Application WO 00/64798-A1, wherein the buffer is disposed not below the elevator car, but near the elevator car at the shaft floor. The elevator car is provided with brackets that impinge on the buffer if an overrun situation arises, i.e. if the elevator car goes beyond the lowermost stopping position at the lowermost floor in the downward direction. The elevator car is thereby braked and stopped in a short distance above the shaft floor. An overrun protection against overrunning the uppermost stopping position of the elevator car in the upward direction is not proposed in this PCT patent application. The elevator installation has a shaft without a pit. A possibility of creating temporary zones of protection for carrying out of maintenance and repair operations in the elevator shaft at the shaft floor and/or at the shaft head is not disclosed.

SUMMARY OF THE INVENTION

The present invention is based on an object of providing a solution which makes it possible to ensure an overrun protection against overrunning a lowermost stopping position of the elevator car in the downward direction and against overrunning an uppermost stopping position of the elevator car in the upward direction.

The buffer according to the present invention projects at least partly into the path of the elevator car and into the path of the counterweight. It is thereby achieved that, with a single buffer, selectably the car or the counterweight can each be supported at a predetermined spacing above the shaft floor. The respective predetermined spacing can be different for the car and the counterweight depending on the respective arrangement and form of the buffer. Thus, solely through the selection of the arrangement of a single buffer the elevator car can be prevented from overrunning the lowermost stopping position in the elevator shaft in the downward direction and the uppermost stopping position in the elevator shaft in the upward direction.

A further embodiment of a buffer according to the present invention can be provided with movable means which can be brought into the path of the elevator car and/or into the path of the counterweight in order to support the elevator car and/or the counterweight in each instance at a second predetermined spacing above the floor of the shaft. This embodiment is accompanied by the advantage that, with a single buffer, the elevator car and/or the counterweight can—depending on the respective setting of the movable means—each be supported at at least two different spacings above the shaft floor. Such a buffer can—suitably dimensioned—ensure, in an elevator installation without a pit, an overrun protection against overrunning a lowermost stopping position of the elevator car in the downward direction and against overrunning an uppermost stopping position of the elevator car in the upward direction and additionally enables, in the case of a suitable setting of removable means, creation of temporary protection spaces at the shaft floor and at the shaft head.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
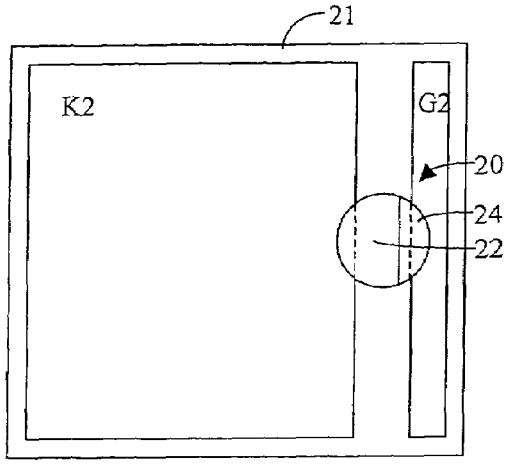
FIG. 1A is a schematic plan view of a first embodiment of a buffer according to the present invention.

FIGS. 1A to 1D show a first embodiment of a buffer 20, according to the present invention, in different schematic views and in different states. The illustrated buffer 20 is a buffer for supporting an elevator car 25 above a floor 28 of an elevator shaft 21. The elevator car 25 is so connected with a counterweight 23 that the elevator car 25 and the counterweight 23 are movable upwardly and downwardly along paths $V_K$ and $V_G$ respectively in the elevator shaft 21. The counterweight 23 and a part of a support cable 23.1 for the elevator car 25 and the counterweight 23 is shown in FIG.

1D, whereagainst a drive pulley for the support cable 23.1, guide rails and other usual elements of an elevator installation are not shown in FIGS. 1A to 1D. The buffer 20 has a longitudinal extent parallel to the paths $V_K$ and $V_G$ of the elevator car 25 and the counterweight 23. The buffer 20 is so constructed and arranged that it projects at least partly into the path $V_K$ of the elevator car and the path $V_G$ of the counterweight.

Figure 1B:
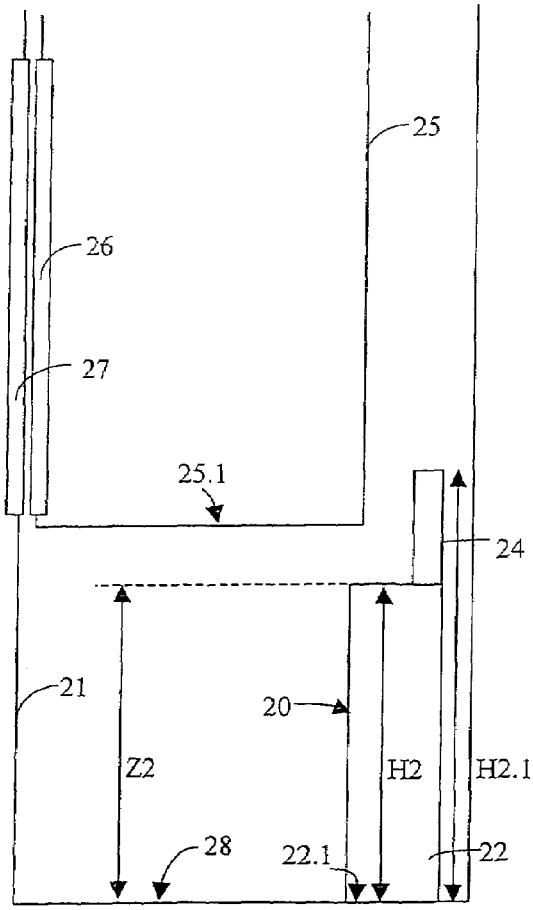
FIG. 1B is a schematic side elevation view of the first buffer wherein an elevator car makes an orderly stop at the level of a lowermost floor.
Figure 1C:
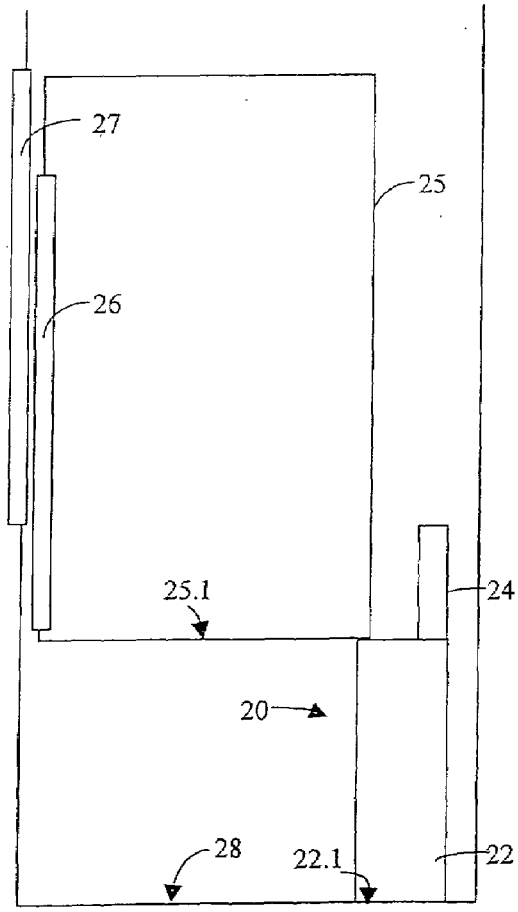
FIG. 1C is a schematic side elevation view of the first buffer wherein the elevator car is shown in an overrun situation and seated on the buffer.
Figure 1D:
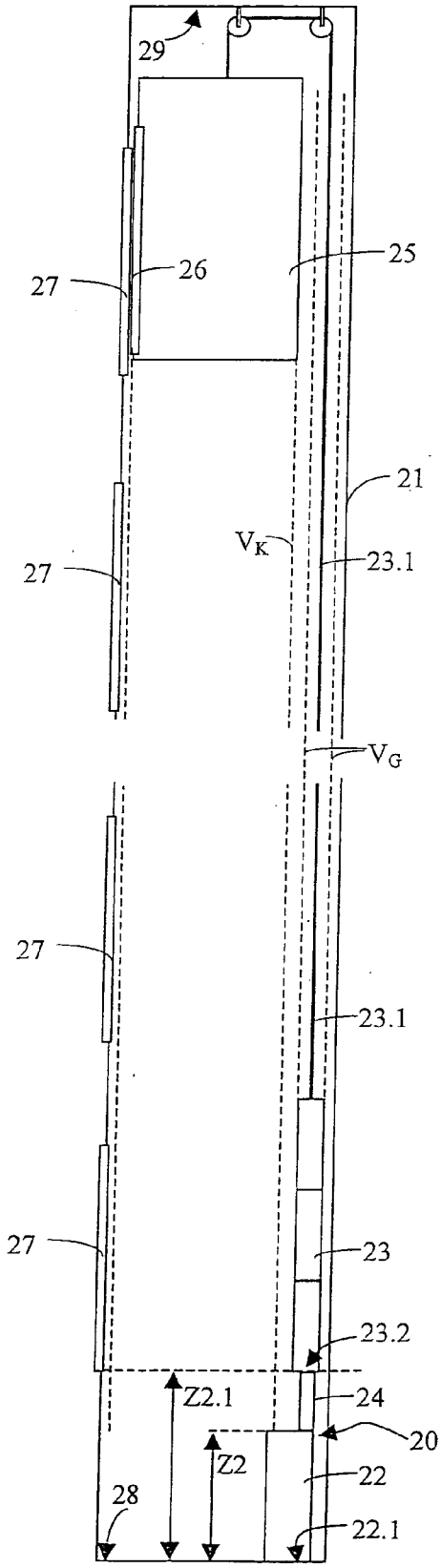
FIG. 1D is a schematic side elevation view of an entire elevator shaft with the first buffer, wherein the elevator car is shown in an overrun situation at the top and a counterweight is seated on the buffer.

The buffer 20 comprises a lower base element 22 and a more slender upper part 24. The upper part 24 is seated asymmetrically on the base element 22. The buffer 20 is shown in FIGS. 1C and 1D in a so-termed operative state.

The buffer 20 is disposed at least partly between the path $V_K$ of the elevator car and the path $V_G$ of the counterweight. These paths $V_K$ and $V_G$ are indicated in FIG. 1D by dashed lines. For clarification, there is shown in FIG. 1A a projection K2 of a floor 25.1 of the elevator car 25 and a projection G2 of an underside 23.2 of the counterweight 23 respectively projected onto the shaft floor. The projections K2 and G2 are illustrated by dashed lines in the regions in which they overlap with a base surface 22.1 of the base element 22 at the shaft floor 28.

In the normal case, i.e. in the case in which the elevator car 25 moves upwardly and downwardly in the region provided for that purpose, the buffer 20 does not come into use. As shown in FIG. 1B, the elevator car 25 can move to the lowermost floor and enables boarding and disembarkation via a car door 26 and a shaft door 27.

If, now, overrunning of the lowermost stopping position of the elevator car 25 in downward direction (use state in FIG. 1C) takes place, a mechanical contact of the elevator car 25 with the base element 22 of the buffer 20 occurs as soon as the elevator car 25 falls below a predetermined vertical spacing Z2 with respect to the floor 28. In the case of the illustrated embodiment, the elevator car 25 is seated by a lower edge on the base element 22, as shown in FIG. 1C. The elevator car 25 can thereby be braked and stopped in the "emergency case". The base element 22 of the buffer 20 is somewhat compressed in this state.

The form of the embodiment of FIGS. 1A to 1D is distinguished by the fact that it not only prevents overrunning of the lowermost stopping position of the elevator car 25 in the downward direction, but overrunning of the uppermost stopping position of the elevator car 25 in the upward direction is arrested. This "emergency case" is illustrated in FIG. 1D. A schematic longitudinal section through the entire elevator shaft 21 is shown in this figure. The elevator shaft 21 has four or more than four floors. One of the shaft doors 27 is indicated at the level of each of the floors. The counterweight 23 moves in the elevator shaft 21 in an opposite sense to the elevator car 25. If the elevator car is located at the upper shaft end, then the counterweight is located at the lower shaft end. An overrunning of the uppermost stopping position of the elevator car 25 in the upward direction is now stopped in accordance with the invention in that the counterweight 23 comes into mechanical interaction with the upper part 24 of the buffer 20. Through braking and stopping the counterweight 23 by the buffer 20, the elevator car 25 is prevented from travelling further upwards.

A zone of protection can also be defined at the upper shaft end depending on a respective total vertical extent H2.1 of the buffer 20.

FIGS. 2A to 2D show a second embodiment of a buffer 40, according to the present invention, in different schematic views and in different states. The illustrated buffer 40 is a buffer for supporting an elevator car 45 above a floor 48 of an elevator shaft 41. The buffer serves as overrun protection and as means for creating a temporary zone of protection in an elevator installation without a pit, i.e. in an elevator installation in which the lowermost stopping level of the elevator car lies at such a short spacing above the floor that there is no room for a shaft pit. The elevator car 45 is so connected with a counterweight (not shown) that the elevator car 45 and the counterweight are movable upwardly and downwardly along paths in the elevator shaft 41. The counterweight, support cables for the elevator car 45 and the counterweight, a drive pulley for the support cables, guide rails and the other usual elements of an elevator installation are not shown in FIGS. 2A to 2D. The buffer 40 has a longitudinal extent parallel to the paths of the elevator car 45 and the counterweight. The buffer 40 is so constructed and arranged that depending on the respective state it projects at least partly into the path of the elevator car and the path of the counterweight.

Figure 2A:
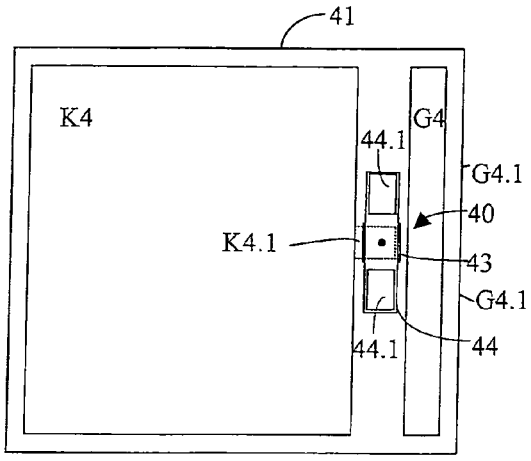
FIG. 2A is a schematic plan view of a second embodiment of a buffer according to the present invention, in a normal state.
Figure 2C:
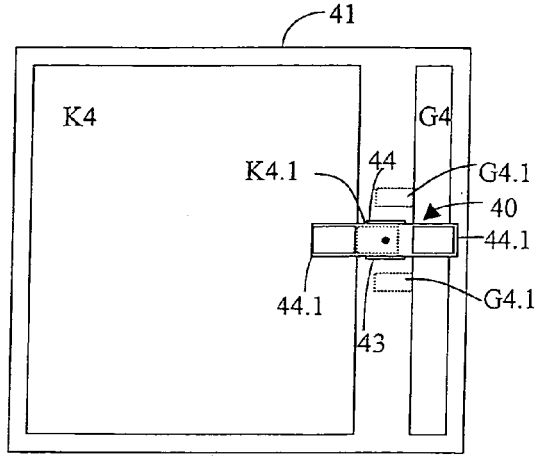
FIG. 2C is a schematic plan view of the second buffer in a use state.
Figure 2B:
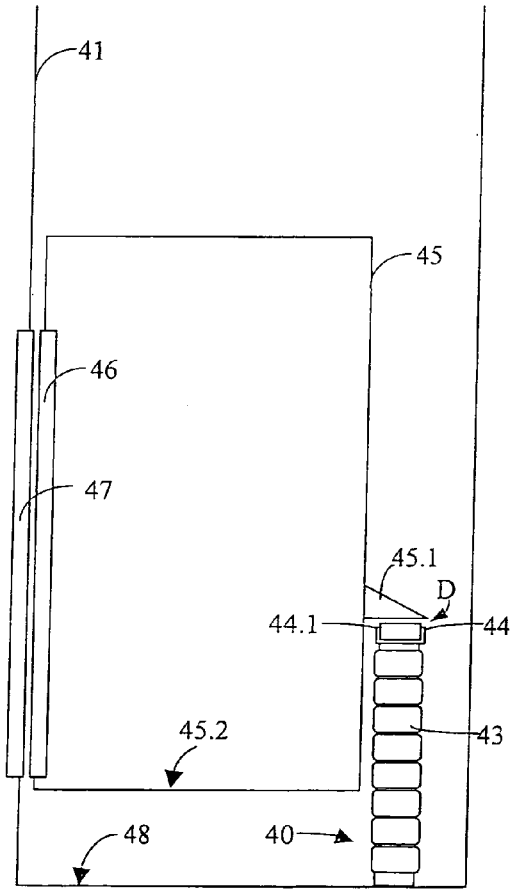
FIG. 2B is a schematic side elevation view of the second buffer in the normal state, wherein the elevator car moving downwardly beyond the lowermost stopping position is stopped.
Figure 2D:
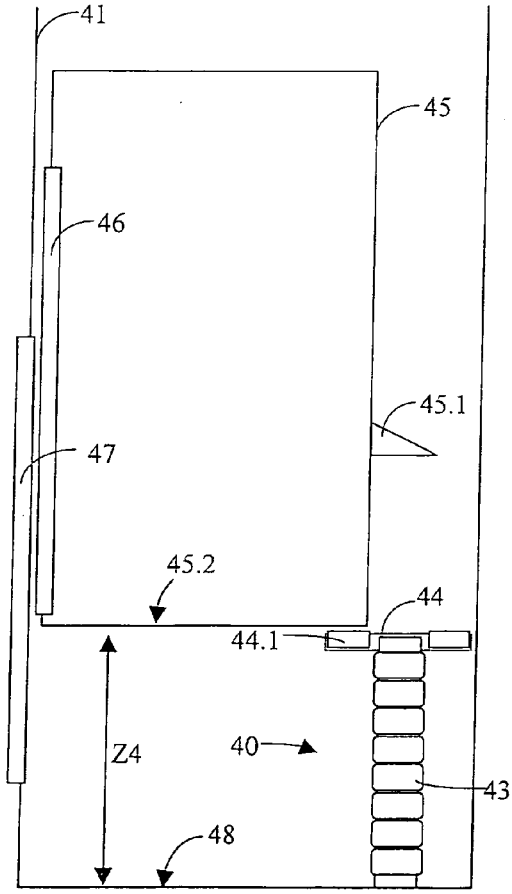
FIG. 2D is a schematic side elevation view of the second buffer in a use state, wherein a temporary zone of protection is ensured.

The buffer 40 comprises a lower base element 43, which is designed as a stronger damper, and a movable means 44 which are seated on the base element 43 and can be rotated at least approximately 90°, as illustrated in FIGS. 2C and 2D. The movable means 44 are symmetrically constructed in the case of the illustrated embodiment, i.e. they project out to the same extent on both sides beyond the base element 43. The movable means 44 comprise dampers 44.1 which are seated in recesses of the movable means 44.

The buffer 40 is shown in FIGS. 2A and 2B in a so-termed normal state. In FIGS. 2C and 2D the buffer 40 is illustrated in a so-termed use state. The buffer 40 is disposed at least partly between the path of the elevator car and the path of the counterweight. For clarification, a projection K4 of a floor 45.2 of the elevator car 45 and a projection G4 of an underside of the counterweight is shown in FIGS. 2A and 2C.

In the use state a mechanical contact of the elevator car 45 with the damper 44.1 of the buffer 40 takes place as soon as the elevator car 45 moves below a first predetermined vertical spacing Z4 with respect to the floor 48. In the case of the illustrated embodiment the elevator car 45 is seated by a lower edge on the damper 44.1, as shown in FIG. 2D. The buffer 40 is thus eccentrically loaded. A temporary zone of protection can thereby be created in the region of the lower shaft end in the case of need.

The buffer 40 together with the movable means 44, 44.1 is so constructed and arranged that in the use state a mechanical contact with the counterweight also takes place if the counterweight falls below the predetermined spacing Z4 with respect to the floor 48. The counterweight is not visible in FIGS. 2A to 2D, since it is disposed at the upper shaft end when the elevator car 45 is disposed at the lower shaft end.

The buffer 40 is shown in the normal state in FIG. 2B. Since in the normal state the movable means 44, 44.1 of the buffer 40 do not project into the path of the floor 45.2 of the elevator car 45, the elevator car 45 can travel to a shaft door 47 of the lower floor without producing a mechanical contact with the buffer 40. It may be mentioned that in the illustrated state a spacing D between a bracket 45.1 (buffer abutment) fastened to the elevator car 45 and the damper 44.1 exists. In the situation shown in FIG. 2B, boarding and disembarkation can take place via a car door 46 and the shaft door 47.

If now an overrunning of the lowermost stopping position of the elevator car 45 in the downward direction (not shown in FIGS. 2A to 2D) happens, then a mechanical contact of the bracket 45.1, which is fastened at the elevator car 45, with the means 44 or with the base element 43, which is designed as a stronger damper, of the buffer 40 takes place. The elevator car 45 can thereby be braked and stopped in the "emergency case". It may be noted that in the case of overrunning the lowermost stopping position of the elevator car 45 the damper 44.1 does not come into use, since the bracket 45.1 produces direct contact with the means 44 or the base element 43. The buffer 40 is thus centrally loaded in such an "emergency case".

If the buffer 40 is disposed in the normal state, then an overrunning of the uppermost stopping position of the elevator car 45 in the upward direction is prevented by the fact that a bracket or another protruding element at the side of the counterweight facing the shaft door 47 produces a contact with the movable means 44 of the buffer 40. This also leads to a central loading of the buffer 40.

A projection K4.1 of the bracket 45.1 and a projection G4.1 of the said bracket or of the protruding element at the counterweight, in each instance projected onto the shaft floor, are respectively illustrated in FIGS. 2A and 2C by dashed lines.

For creating a zone of protection the buffer 40 is led over from the normal state to the use state, wherein that takes place in that the movable means 44 are rotated into the paths of the floor 45.2 of the elevator car 45 or the underside of the counterweight (FIGS. 2C and 2D). The necessary changeover can be triggered, for example, by a (key-operated) switch or by electronic control. In order to create the temporary zone of protection, the elevator car 45 is moved slowly downwardly until it rests on the damper 44.1. A person can go into and/or leave the zone of protection by opening of the shaft door 47. The spacing Z4 ensures sufficient spacing from the floor 48 in order to enable a safe and problem-free working in the zone of protection.

A temporary zone of protection can also be created in the region of the upper shaft end by the same buffer 40. However, this state is not shown in FIGS. 2A to 2D. In order to create a zone of protection at the upper shaft end, the counterweight is prevented from falling below the spacing Z4 from the floor 48. As soon as the counterweight sits on the damper 44.1 on the right-hand side of the movable means 44, the elevator car 45 is held at a fixedly predetermined spacing from the shaft head. A zone of protection of the upper shaft end thereby results.

As indicated in FIGS. 1C and 1D, the elevator car and the counterweight do not have to be supported at the same height.

According to the invention the buffer can have a damping characteristic which is specially adapted to the case of use. In the case of the second embodiment the dampers 44.1 are used which enable a lightly damped settling of the elevator car 45 or the counterweight when a zone of protection is to be created. On overrunning beyond the lowermost or the uppermost stopping position of the elevator car 45, thereagainst, the damping characteristic of the base element 43 comes into play.

The buffers according to the present invention can be equipped with special means which allow an asymmetrical loading without the buffer "collapsing" or "deflecting". For this purpose the buffer can be surrounded entirely or partly by a corset-like element or be guided by special means in order to provide compensation for the bending moments occurring due to the eccentric buffer loading.

The buffer can be arranged completely between the elevator car and the counterweight (see, for example, FIG. 2A).

The cross-section of the buffer according to the present invention can be selected as desired. The buffer 20 has a substantially round cross-section parallel to the floor of the elevator shaft. The buffer 40, thereagainst, has, for example, a square cross-section in the lower region 43.

Depending on the respective form of embodiment a movement of the movable means of the buffer can be effected electromagnetically, hydraulically, pneumatically, manually or by means of a setting motor.

In a further embodiment a pit set is employed which comprises a drive/frequency-converter unit 30 (FIG. 1C), a speed limiter, a fastening for the guide rails and the buffer. Mounting in the elevator shaft is thereby noticeably simplified.

The present invention is also suitable for use in an elevator installation in cantilever disposition.

A reduced requirement for space by comparison with conventional solutions results from the special arrangement and construction of the buffer.

The buffer according to the present invention is particularly suitable for use in elevator installations which have no, or only a small, shaft pit height size and shaft head height size.

It is an advantage of the present invention that regulations for fulfillment of protection of persons can be observed and the constructional costs or installation costs can be substantially reduced depending on the respective form of embodiment.

The movable means 44 and 44.1 can be modified in various ways within the scope of the invention. They can be means which are foldable, pivotable, slidable and/or rotatable out of a basic setting and are respectively movable in tracks of the elevator car and the counterweight in order to support the elevator car and/or the counterweight at a spacing above the floor. The movable means can also be so designed by a suitable arrangement that the elevator car and the counterweight can be respectively supported at different heights.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A buffer for supporting an elevator car and a counterweight for the elevator car, wherein the elevator car and the counterweight are movable along paths in an elevator shaft, comprising: a buffer adapted to be mounted in an elevator shaft and having mechanical contact means whereby when said buffer is mounted in the elevator shaft, said mechanical contact means projects at least partly into the path of the elevator car and the path of the counterweight.

2. The buffer according to claim 1 wherein said mechanical contact means of said buffer engages in mechanical contact with the elevator car when the elevator car moves below a first predetermined spacing with respect to a floor of the elevator shaft and engages in mechanical contact with the counterweight when the counterweight moves below a second predetermined spacing with respect to the floor.

3. The buffer according to claim 1 wherein an upper part of said buffer is disposed between an area projection of the elevator car and an area projection of the counterweight.

4. The buffer according to claim 1 wherein said buffer provides overrun protection for the elevator car by said mechanical contact means braking and stopping at least one of the elevator car on overrunning a lowermost stopping position in a downward direction and the counterweight on the elevator car overrunning an uppermost stopping position in an upward direction.

5. The buffer according to claim 1 wherein said buffer includes movable means attached to said mechanical contact means for movement into the path of the elevator car in order to produce the mechanical contact with the elevator car and movement out of the path of the elevator car for the elevator travelling past the buffer in a normal state if there is no need for a lower zone of protection.

6. The buffer according to claim 5 wherein said movable means are one of foldable, pivotable, slidable and rotatable for said movement into and out of the path of the elevator car.

7. The buffer according to claim 1 wherein said buffer includes movable means attached to said mechanical contact means for movement into the path of the counterweight in order to produce the mechanical contact with the counterweight and for movement out of the path of the counterweight for the counterweight travelling past the buffer in a normal state if there is no need for an upper zone of protection.

8. The buffer according to claim 7 wherein said movable means are one of foldable, pivotable, slidable and rotatable for said movement into and out of the path of the counterweight.

9. The buffer according to claim 1 wherein said buffer is formed with a damping characteristic suitable for braking and stopping the elevator car or the counterweight.

10. The buffer according to claim 1 wherein said mechanical contact means contacts one of the elevator car and the counterweight for producing at least one of a zone of protection between a floor and the elevator car and a zone of protection above the elevator car.

11. An elevator installation having an elevator shaft comprising:

an elevator car positioned in an elevator shaft;

a counterweight connected to the elevator car, said elevator car and said counterweight being movable along paths in the elevator shaft; and a buffer mounted in the elevator shaft and having mechanical contact means projecting at least partly into the path of the elevator car and the path of the counterweight.

12. The elevator installation according to claim 11 wherein the elevator shaft is without a pit.

13. The elevator installation according to claim 11 including a drive arranged at a floor of the elevator shaft.

* * * * *